US012259201B2

(12) United States Patent
Komuro et al.

(10) Patent No.: US 12,259,201 B2
(45) Date of Patent: Mar. 25, 2025

(54) HEADER PLATES STRUCTURE OF HEAT EXCHANGER

(71) Applicant: T.RAD CO., LTD., Tokyo (JP)

(72) Inventors: Akira Komuro, Tokyo (JP); Taiji Sakai, Tokyo (JP); Atsushi Okubo, Tokyo (JP); Hiro Kubota, Tokyo (JP)

(73) Assignee: T.RAD Co., Ltd., Tokyo (JP)

( * ) Notice: Subject to any disclaimer, the term of this patent is extended or adjusted under 35 U.S.C. 154(b) by 197 days.

(21) Appl. No.: 18/016,472

(22) PCT Filed: Jul. 9, 2021

(86) PCT No.: PCT/JP2021/026900
§ 371 (c)(1),
(2) Date: Jan. 17, 2023

(87) PCT Pub. No.: WO2022/014719
PCT Pub. Date: Jan. 20, 2022

(65) Prior Publication Data

US 2023/0280112 A1 Sep. 7, 2023

(30) Foreign Application Priority Data

Jul. 17, 2020 (JP) ..... 2020-123296

(51) Int. Cl.
*F28F 9/02* (2006.01)

(52) U.S. Cl.
CPC ..... *F28F 9/0202* (2013.01)

(58) Field of Classification Search
CPC .. F28F 9/0202; F28F 2265/26; F28F 2275/04; F28F 9/0226; F28F 9/0204; F28F 9/0207; F28F 9/0212; F28F 9/0219; F28F 9/0231; F28F 9/0246; F28D 1/05391
See application file for complete search history.

(56) References Cited

U.S. PATENT DOCUMENTS 4,244,194 A * 1/1981 Haesters ..... F25B 39/02 165/173
2005/0039900 A1* 2/2005 Yu ..... F28F 9/02 165/173
2018/0363987 A1* 12/2018 Itou ..... F28D 1/05375
2020/0256627 A1* 8/2020 Armsden ..... F28F 9/0263
(Continued)

FOREIGN PATENT DOCUMENTS

DE 102007044742 A1 4/2009
FR 2785376 A1 5/2000
(Continued)

*Primary Examiner* — Nelson J Nieves
(74) *Attorney, Agent, or Firm* — Norris McLaughlin, P.A.

(57) ABSTRACT

In a header plate structure of heat exchangers having a core divided in plurality, a flat tube is inserted into each of the tube insertion holes having a burring, which is formed in a header plate; the flat tube is joined at an inner surface in the vicinity of a top portion of the burring; a burring with height H1 is formed to a long side portion of a dummy tube insertion hole; and a burring with height H2 is formed to a long side portion of an end portion tube insertion hole adjacent to the dummy tube insertion hole, in which height H2 of the burring of the end portion tube insertion hole has been formed higher than the height H1 of the burring of the dummy tube insertion hole.

2 Claims, 7 Drawing Sheets

(56) References Cited

U.S. PATENT DOCUMENTS

| | | | | |
|---|---|---|---|---|
| 2021/0325116 | A1* | 10/2021 | Wang | F28D 1/0443 |
| 2022/0282938 | A1* | 9/2022 | Komuro | F28D 1/0443 |
| 2022/0333873 | A1* | 10/2022 | Komuro | B23K 1/00 |
| 2024/0255238 | A1* | 8/2024 | Shi | F28F 9/26 |

FOREIGN PATENT DOCUMENTS

| | | | |
|---|---|---|---|
| JP | 2002-115991 | A | 4/2002 |
| WO | 2010/133491 | A1 | 11/2010 |
| WO | 2020/158364 | A1 | 8/2020 |

* cited by examiner

HEADER PLATES STRUCTURE OF HEAT EXCHANGER

TECHNICAL FIELD

The present invention relates to a header plate structure of a heat exchanger, which is optimized for a heat exchanger having a core divided in plurality, and relates in particular to one that reduces thermal stress and strain applied to flat tubes and header plates thereof.

BACKGROUND ART

As a heat exchanger in which a core divided in plurality in a longitudinal direction of a tank is formed, Patent Literature 1 below is known.

In the heat exchanger, as shown in FIG. 5, FIG. 6A,6B, a core is formed with many flat tubes 32 arranged in a row, and a front end of each flat tube 32 is inserted into a tube insertion hole 4 drilled in a bottom surface 10 of a pair of header plates 1. Between respective flat tubes, a corrugated fin 33 is arranged.

Further, the pair of header plates 1 is covered with a tank main body 21 to form a tank. As shown in FIG. 7, by caulking a claw portion 13 provided for the header plate 1 to a small flange 25 of the tank main body 21, the tank main body 21 is fixed to the header plate 1.

To the tank main body 21, there are formed a pair of partitioning portions 22 that divide a flow path of a heat medium flowing into the inside of the core.

As shown in FIG. 6B, a dummy tube insertion hole 6 is formed in the bottom surface 10 of the header plate 1 in a part where the pair of partitioning portions 22 of the tank main body 21 lie, and a flat tube 32 has been inserted into the dummy tube insertion hole 6. Into the flat tube 32 inserted into the dummy tube insertion hole 6, a heat medium does not flow. In an instance where the tank main body 21 covers the header plate 1, a longitudinal direction of the tank main body 21 is divided into a first tank portion 23 and a second tank portion 24 defining the dummy tube insertion hole 6 as a border.

Further, as shown in FIG. 5, a part of the core divided by the first tank portion 23 forms a first core 34, and a part of the core divided by the second tank portion 24 forms a second core 35. It becomes possible to flow different heat media to the first core 34 and the second core 35, respectively.

CITATION LIST

Patent Literature

PTL 1: Japanese Patent Laid-Open No. 2002-115991

SUMMARY OF INVENTION

Technical Problem

However, in the heat exchanger described in Patent Literature 1, in an instance where temperature difference exists between heat media flowing into respective cores 34, 35, thermal strain is generated between the cores 34, 35. Further, thermal stress is generated between both cores 34, 35 every time when the heat exchanger is operated, and, as a result of long-time use, cracks might be generated in a flat tube 32 that is arranged near the partitioning portion 22 of the tank main body 21 and into which the heat medium flows.

Thus, the present invention is directed to achieve reduction of thermal stress and strain generated in the flat tube 32 arranged near the partitioning portion 22 of the tank main body 21.

Meanwhile, in a part of the bottom surface 10 of the header plate 1 in which the pair of partitioning portions 22 of the tank main body 21 lie, it is necessary to secure sufficient sealing surface for arranging a sealing ring 31.

Solution to Problem

The present invention according to a first aspect thereof is a header plate structure of a heat exchanger, including:

an elongated header plate 1, in which flat and many tube insertion holes 4 constituted of a pair of short side portions 2 facing each other and a pair of long side portions 3 linking between both of the short side portions 2 are formed in a bottom surface 10;

a tank main body 21 caulked and fixed to the header plate 1 via a sealing ring 31; and a flat tube 32 whose end portion is inserted into the header plate 1, the inserted portion being brazed and fixed to form a core, in which:

each short side portion 2 of the many tube insertion holes 4 lies in a width direction of the header plate 1, and the tube insertion holes 4 are arranged separately from each other in a longitudinal direction of the header plate 1;

in the tank main body 21, a pair of partitioning portions 22 dividing the same into plurality in a longitudinal direction are included, a tube insertion hole 4 arranged between the partitioning portions 22 among the tube insertion holes 4 is formed as a dummy tube insertion hole 6, and the core is divided at a position of the dummy tube insertion hole 6, wherein:

each tube insertion hole 4 arranged adjacent to both sides of the dummy tube insertion hole 6 has been formed as an end portion tube insertion hole 5;

the flat tube 32 has been inserted into each of the tube insertion holes 4, 5, 6, a burring 8 is formed to a hole edge of each of the tube insertion holes 4, 5, 6, and the flat tube 32 has been joined on an inner surface near a top portion 8*a* of the burring 8 of each of the tube insertion holes 4, 5, 6;

the burring 8 with height H1 is formed to the long side portion 3 of the dummy tube insertion hole 6;

the burring 8 with height H2 is formed to the long side portion 3 of the end portion tube insertion hole 5 adjacent to the dummy tube insertion hole 6; and the height H2 of the burring 8 of the end portion tube insertion hole 5 is formed higher than the height H1 of the burring 8 of the dummy tube insertion hole 6.

The present invention according to a second aspect is the header plate structure of a heat exchanger according to the first aspect, wherein a ratio of the height H1 of the burring 8 of the dummy tube insertion hole 6 and the height H2 of the burring 8 of the end portion tube insertion hole 5 is $H2/H1 \geq 1.5$.

Advantageous Effects of Invention

In the first aspect of the invention, the burring 8 with height H1 is formed to the long side portion 3 of the dummy tube insertion hole 6, the burring 8 with height H2 is formed to the long side portion 3 of the end portion tube insertion hole 5 adjacent to the dummy tube insertion hole 6, and the height H2 of the burring 8 of the end portion tube insertion hole 5 is formed higher than the height H1 of the burring 8 of the dummy tube insertion hole 6.

Further, regarding to the burring 8 of the end portion tube insertion hole 5 adjacent to the dummy tube insertion hole 6, the joined portion between the burring 8 and the flat tube 32 is formed near the top portion 8*a* of the burring 8 to result in longer distance from the bottom surface 10 of the header plate 1 to the joined portion with the flat tube 32, and stress generated in the header plate 1 and the joined portion due to thermal deformation of the flat tube 32 is distributed entirely in the burring 8.

Therefore, as a result of reducing stress generated in the joined portion between the burring 8 of the end portion tube insertion hole 5 being adjacent to the dummy tube insertion hole 6 and the flat tube 32, cooling/heating durability can be improved.

Moreover, as Comparative Example in FIG. 4, in an instance where the burring 8 of the end portion tube insertion hole 5 adjacent to the dummy tube insertion hole 6 is formed larger than the burring 8 of the dummy tube insertion hole 6, the curvature radius of the former burring 8 becomes large and, as a result, a root of the burring 8 of the end portion tube insertion hole 5 lies toward the adjacent dummy tube insertion hole 6 side. Therefore, where the dummy tube insertion hole 6 is formed with an ordinary burring height, it becomes difficult to secure a sufficient intertube sealing surface 12 on the bottom surface 10 of the header plate 1 lying between the dummy tube insertion hole 6 and the end portion tube insertion hole 5 adjacent to the same. Then, the sealing ring 31 runs on the burring 8 of the dummy tube insertion hole 6, and a sufficient sealing effect cannot be expected around the partitioning portion 22 of the tank main body 21.

Therefore, in the present invention, the height of the burring 8 of the dummy tube insertion hole 6 is formed so that curvature radius is lower than the height of the burring 8 of the end portion tube insertion hole 5 adjacent to the dummy tube insertion hole 6, and as a result of setting a rising position of the burring 8 to lie near the dummy tube insertion hole 6 side, it is possible to secure an intertube sealing surface 12 sufficient for exhibiting the effect of the sealing ring 31 around the partitioning portion 22 of the tank main body 21.

In the second aspect of the invention, in the above-described constitution, the ratio of the height H1 of the burring 8 of the dummy tube insertion hole 6 and the height H2 of the burring 8 of the end portion tube insertion hole 5 is set to be $H2/H1 \geq 1.5$.

Thereby, increased height H2 of the burring 8 of the end portion tube insertion hole 5 adjacent to the dummy tube insertion hole 6 reduces more and more the stress applied to the joined portion of the flat tube 32 and the burring 8 of the end portion tube insertion hole 5 adjacent to the dummy tube insertion hole 6. In an instance where the height H2 is set to be equal to or more than 1.5 times the height H1 of the burring 8 of the dummy tube insertion hole 6, the distance from the bottom surface 10 of the header plate 1 to the joined portion of the flat tube 32 may become furthermore longer to improve the stress reduction effect.

DESCRIPTION OF EMBODIMENTS

Figure 1A:
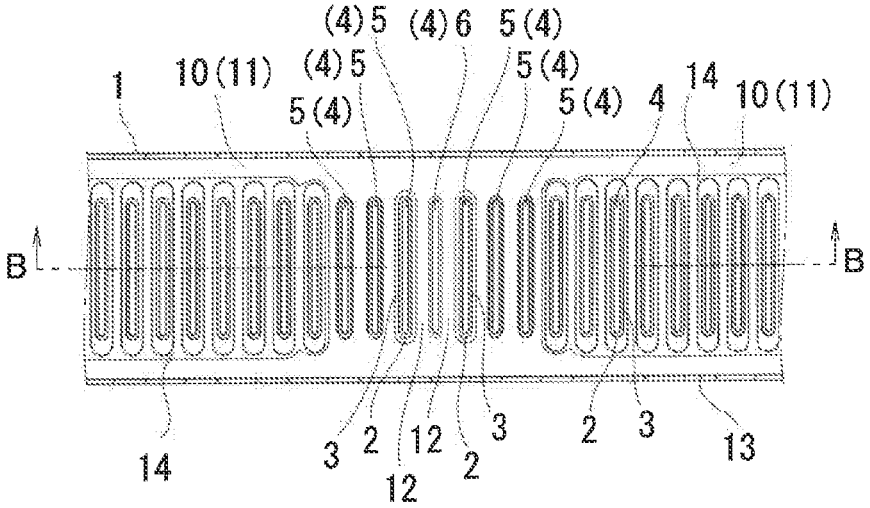
FIG. 1A illustrates a plan view of a main part of the header plate 1 for use in the header plate structure of the present invention.

Next, on the basis of drawings, embodiments of the present invention will be explained with examples.

This heat exchanger is, as an example, suitable for use in radiators for cooling engine cooling water, etc.

The tank of this heat exchanger is constituted of a tank main body 21 and a header plate 1.

The tank main body 21 is made of a synthetic resin material in this Example, and is formed in a box shape having an opening on a side to be linked to the header plate 1. Facing the opening, a bottom is formed. On a rim of the opening, there is formed a small flange 25 evaginating toward the outside of the tank main body 21.

Further, inside the tank main body 21, as an example, a pair of partitioning portions 22 are arranged facing each other, separately around one width in the latitudinal direction of a flat tube 32. The partitioning portion 22 is formed, as shown in FIG. 2B, in an intermediate position in the longitudinal direction of the tank main body 21, and is formed from the bottom of the tank main body 21 toward a bottom surface 10 of the header plate 1. Each end portion of the partitioning portions 22 is linked to the bottom surface 10 of the header plate 1 via an annular sealing ring 31.

Inside of the tank main body 21 is divided with the pair of partitioning portions 22, and on both sides of the pair of partitioning portions 22, a first tank portion 23 and a second tank portion 24 are formed.

The header plate 1 has a square plane and is formed in an elongated shape. In the bottom surface 10 of the header plate 1, as shown in FIG. 1A, there are formed plural flat tube insertion holes 4 constituted of a pair of short side portions 2 facing each other and a pair of long side portions 3 that link between both of the short side portions 2 thereof. The short side portion 2 of the tube insertion hole 4 lies in the width direction of the header plate 1, and the tube insertion holes 4 are arranged separately from each other in the longitudinal direction of the header plate 1.

In the header plate 1, in a position of an intermediate portion in the longitudinal direction of the header plate 1, specifically, in a position corresponding to the space between the pair of partitioning portions 22 formed to the tank main body 21, a dummy tube insertion hole 6 (constituted of a pair of short side portions 2 and a pair of long side portions 3 in the same way as the tube insertion hole 4) is formed.

Across the dummy tube insertion hole 6, an end portion tube insertion hole 5 (constituted of a pair of short side portions 2 and a pair of long side portions 3 in the same way as the tube insertion hole 4) and the tube insertion hole 4 are arranged in order in a row on both sides thereof.

Each of the inner circumferences of the tube insertion hole 4, the end portion tube insertion hole 5 and the dummy tube insertion hole 6 are identical. On the hole edge of each of the insertion holes 4, 5, 6, there is formed a burring 8 projecting toward the inside of the tank main body 21. In the burring 8, a space between a top portion 8*a* and a root 8*b* is linked smoothly with a curved surface. Inside a vicinity of the top portion 8*a*, a joint surface 9 formed in a flat plane is included so that it may be easily joined with a flat tube 32.

Figure 1B:
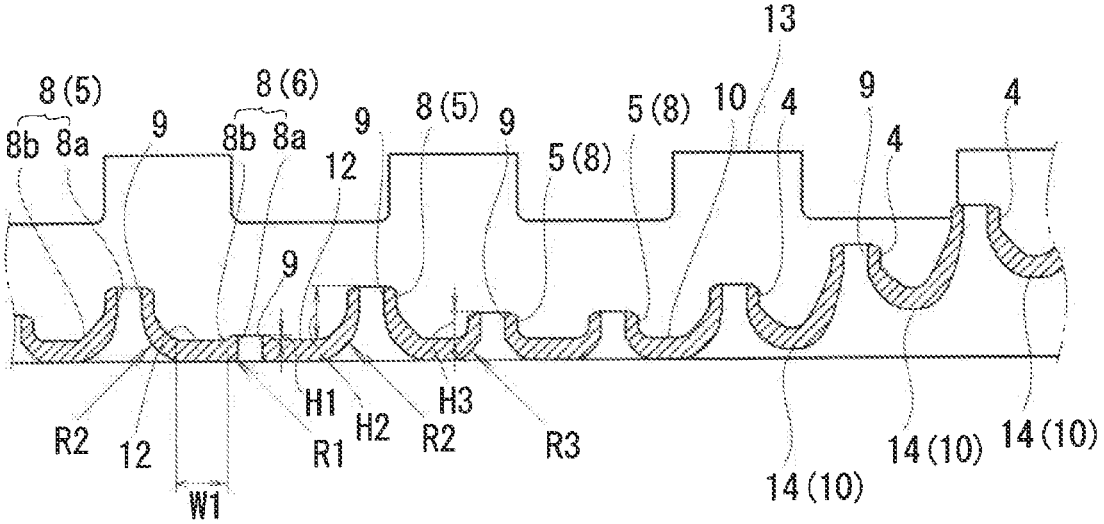
FIG. 1B illustrates cross-sectional view seen along a B-B arrow in FIG. 1A.

On the outer circumference of the header plate 1, as described in FIG. 1B, there are formed an outer circumference wall rising toward the tank main body 21 side, and a claw portion 13 for caulking on the front end part thereof.

As shown in FIG. 2B, on the bottom surface 10 formed to the tube insertion hole 4, there is formed a protruding portion 14 that protrudes toward the inside of the tank main body 21. The bottom surface 10 of the protruding portion 14 lies in a level higher than that of each bottom surface 10 formed to the dummy tube insertion hole 6 and the end portion tube insertion hole 5.

Figure 3A:
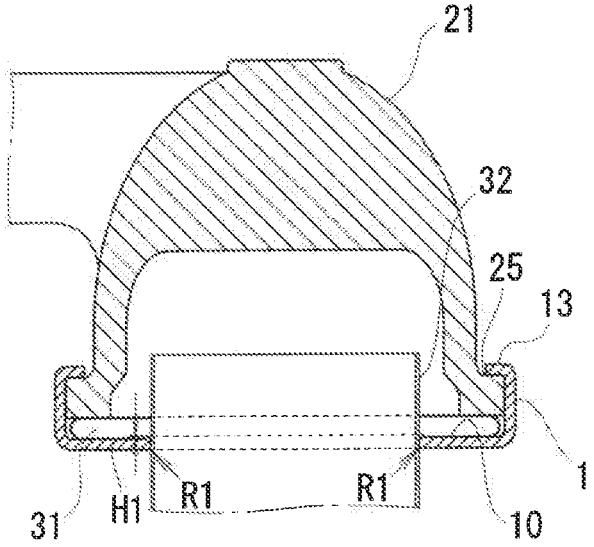
FIG. 3A illustrates a cross-sectional view seen along a IIIA-IIIA arrow in FIG. 2A.
Figure 3B:
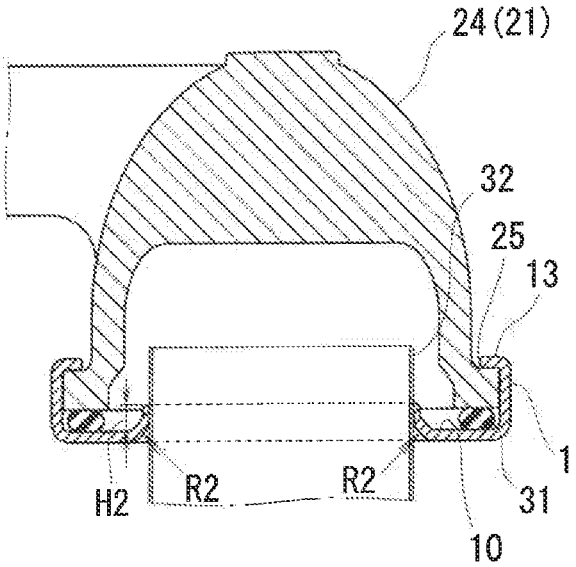
FIG. 3B illustrates a cross-sectional view seen along a IIIB-IIIB arrow in FIG. 2A.
Figure 3C:
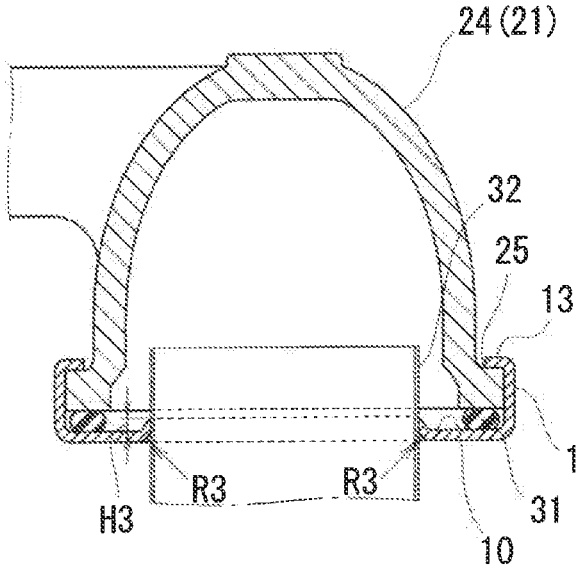
FIG. 3C illustrates a cross-sectional view seen along a IIIC-IIIC arrow in FIG. 2A.
Figure 3D:
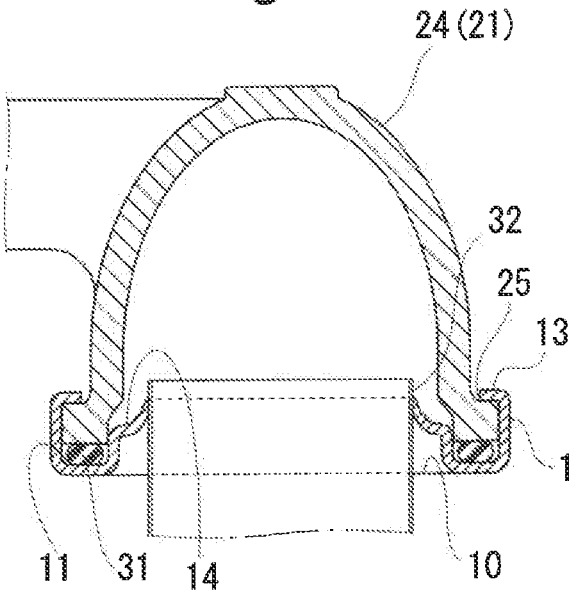
FIG. 3D illustrates a cross-sectional view seen along a IIID-IIID arrow in FIG. 2A.

As shown in FIG. 1 and FIG. 3D, a groove 11 is formed between the outer circumference rim of the bottom surface 10 of this protruding portion 14 and the outer circumference wall of the header plate 1. Rigidity in a region of the bottom portion 10 of the protruding portion 14 becomes higher than rigidity of the bottom portion 10 formed to the dummy tube insertion hole 6 and the end portion tube insertion hole 5.

In this heat exchanger, many flat tubes 32 are arranged in a row to form a core. Into each of the insertion holes 4, 5, 6, the end portion of the flat tube 32 is inserted, and the flat tube 32 and the joint surface 9 of the burring 8 of each of the inserted portions 4, 5, 6 have been brazed and fixed. Between each of the flat tubes 32, as in FIG. 2B, a fin 33 in a corrugated shape can be arranged.

Figure 2A:
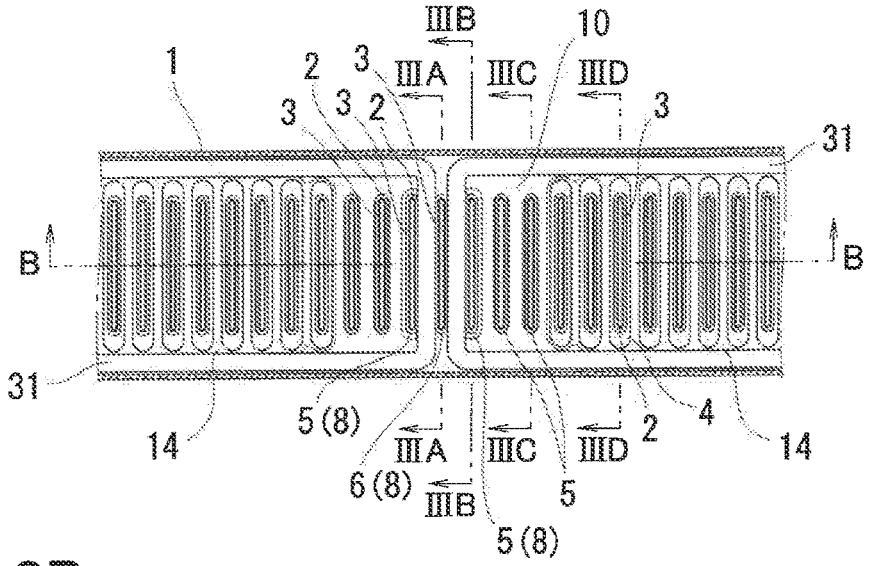
FIG. 2A illustrates a main part plan view showing the header plate structure of the present invention.
Figure 2B:
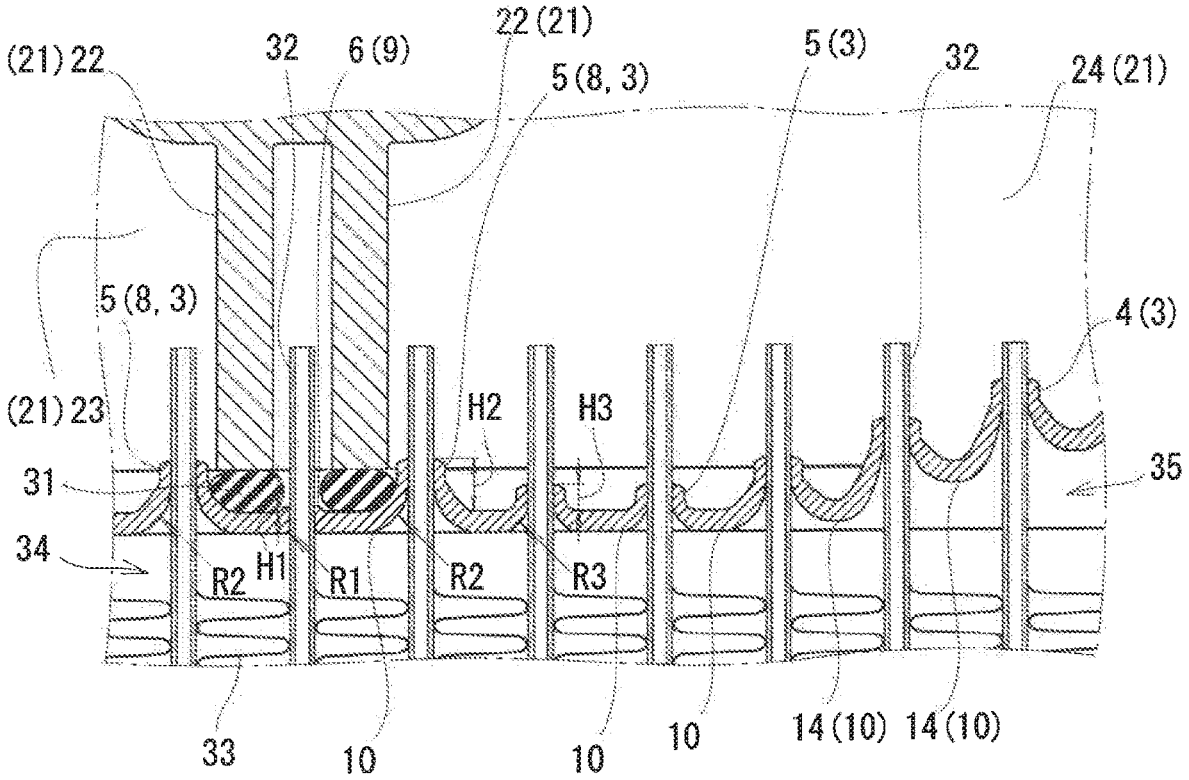
FIG. 2B illustrates an enlarged cross-sectional view seen along a B-B arrow in FIG. 2A.

The sealing ring 31 is arranged, as shown in FIG. 2A, on the groove 11 of the header plate 1, and on the intertube sealing surface 12 lying between the dummy tube insertion hole 6 and the end portion tube insertion hole 5 adjacent to it. Via the sealing ring 31, the opening of the tank main body 21 is fitted to the header plate 1. Further, the claw portion 13 of the header plate 1 is caulked toward the small flange 25 side of the tank main body 21 to fix the tank main body 21 and the header plate 1.

Regarding the pair of partitioning portions 22, each front end of partitioning portions 22 abuts on the sealing ring 31, as shown in FIG. 2B, in the position of the intertube sealing surface 12.

With the dummy tube insertion hole 6, the pair of partitioning portions 22 within the tank main body 21, and the flat tube 32 inserted into the dummy tube insertion hole 6, the core is divided on both sides in the longitudinal direction of the dummy tube insertion hole 6.

A first core 34 is arranged on the first tank portion 23 side, a second core 35 is arranged on the second tank portion 24 side, and different heat media can be flown into the cores 34, 35. As an example, it is possible to allow engine cooling water to circulate through the first core 34, and component cooling water to circulate through the second core 35.

In the above-described heat exchanger, in an instance where temperature difference exists between heat media flowing into each of the cores 34, 35, thermal strain is generated between the cores 34, 35, and thermal stress is generated between both cores 34, 35 in every operation of the heat exchanger. In particular, thermal stress tends to be generated in the flat tube 32 lying near the partitioning portion 22 of the tank main body 21 being a boundary of both cores 34, 35.

Regarding regions of bottom portions 10 formed to the dummy tube insertion hole 6 and the end portion tube insertion hole 5, the protruding portion 14 has not been formed, so that rigidity of circumference portions of the insertion holes 5, 6 is formed weaker relative to other rigidity. Thus, stress generated in the flat tube 32 inserted into the dummy tube insertion hole 6 lying near the partitioning portion 22 of the tank main body 21 and the end portion tube insertion hole 5 is absorbed. A larger number of the end portion tube insertion holes 5 gives more and more remarkable effect. In this example, respective three end portion tube insertion holes 5 are formed adjacent to both sides of the dummy tube insertion hole 6.

This Example has a structure for reducing more effectively thermal stress generated in the vicinity of the partitioning portion 22.

On the long side portion 3 of the end portion tube insertion hole 5 adjacent to the dummy tube insertion hole 6, there is formed the burring 8 having the height H2 from the root 8*b* of the burring 8 to the top portion 8*a* of the burring 8.

On the long side portion 3 of the dummy tube insertion hole 6, there is formed the burring 8 having the height H1 from the bottom surface 10 of the header plate 1 to the top portion 8*a* of the burring 8.

As shown in FIG. 1B, the height H2 of the burring 8 of the end portion tube insertion hole 5 is formed higher than the height H1 of the burring 8 of the dummy tube insertion hole 6.

Regarding the end portion tube insertion hole 5 deviating from positions adjacent to the dummy tube insertion hole 6, as shown in FIG. 1B, to the long side portion 3 thereof, a burring 8 having height H3 from the bottom surface 10 of the header plate 1 to the top portion 8*a* of the burring 8 can be formed. The height H3 may be satisfied when formed equal to or lower than the height H2, and higher than the height H1.

Thermal stress applied to the flat tube 32 of the end portion tube insertion hole 5 deviating from the positions adjacent to the dummy tube insertion hole 6 becomes smaller than thermal stress applied to the flat tube 32 of the end portion tube insertion hole 5 adjacent to the dummy tube insertion hole 6, and therefore not so large height is required.

Regarding the burring 8 of the end portion tube insertion hole 5 adjacent to the dummy tube insertion hole 6, the joint surface 9 thereof is formed in the vicinity of the top portion 8*a* of the burring 8, and distance from the root 8*b* of the burring to the joint surface 9 of the flat tube 32 becomes long. That is, curvature radius R2 of a curved surface running from the root 8*b* of the burring 8 of the end portion tube insertion hole 5 to the top portion 8*a* becomes large. Accordingly, stress generated in the header plate 1 and joined portion due to thermal deformation of the flat tube 32 is distributed entirely over the curved surface of the burring 8.

Consequently, stress generated in the joined portion between the burring 8 of the end portion tube insertion hole 5 adjacent to the dummy tube insertion hole 6 and the flat tube 32 may be reduced to thereby improve cooling/heating durability.

Figure 4:
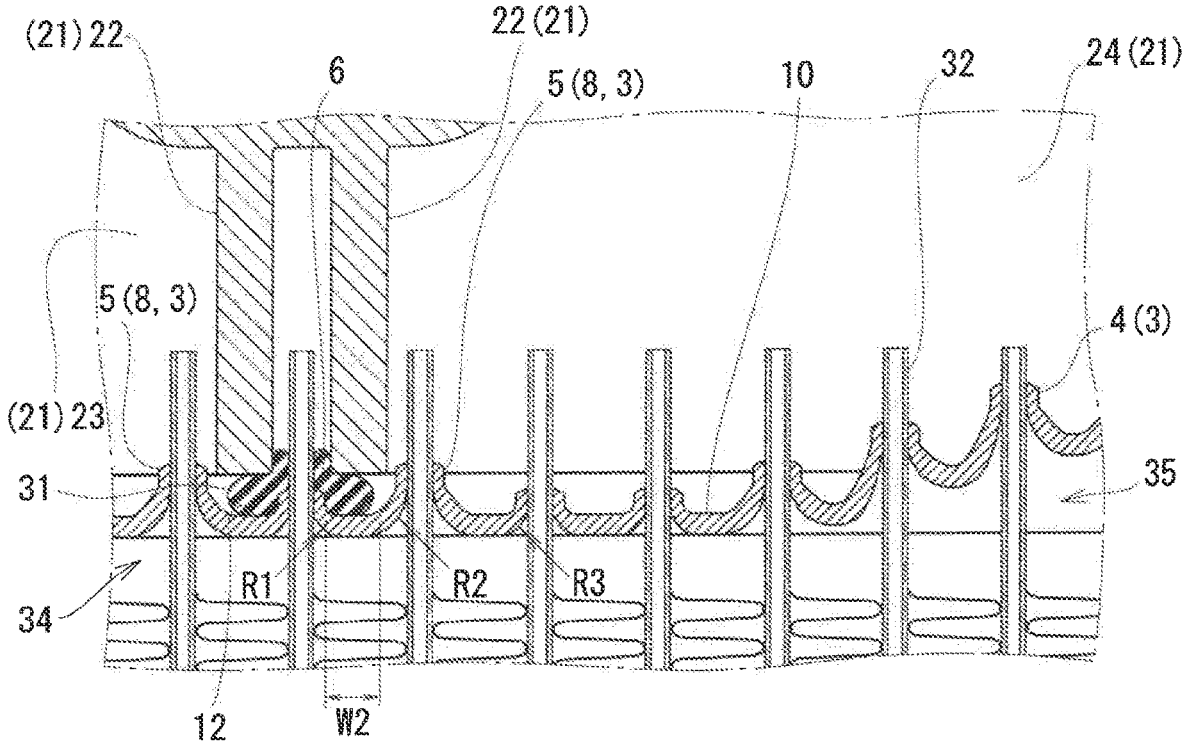
FIG. 4 illustrates an explanatory view showing Comparative Example relative to the header plate structure of the present invention.
Figure 5:
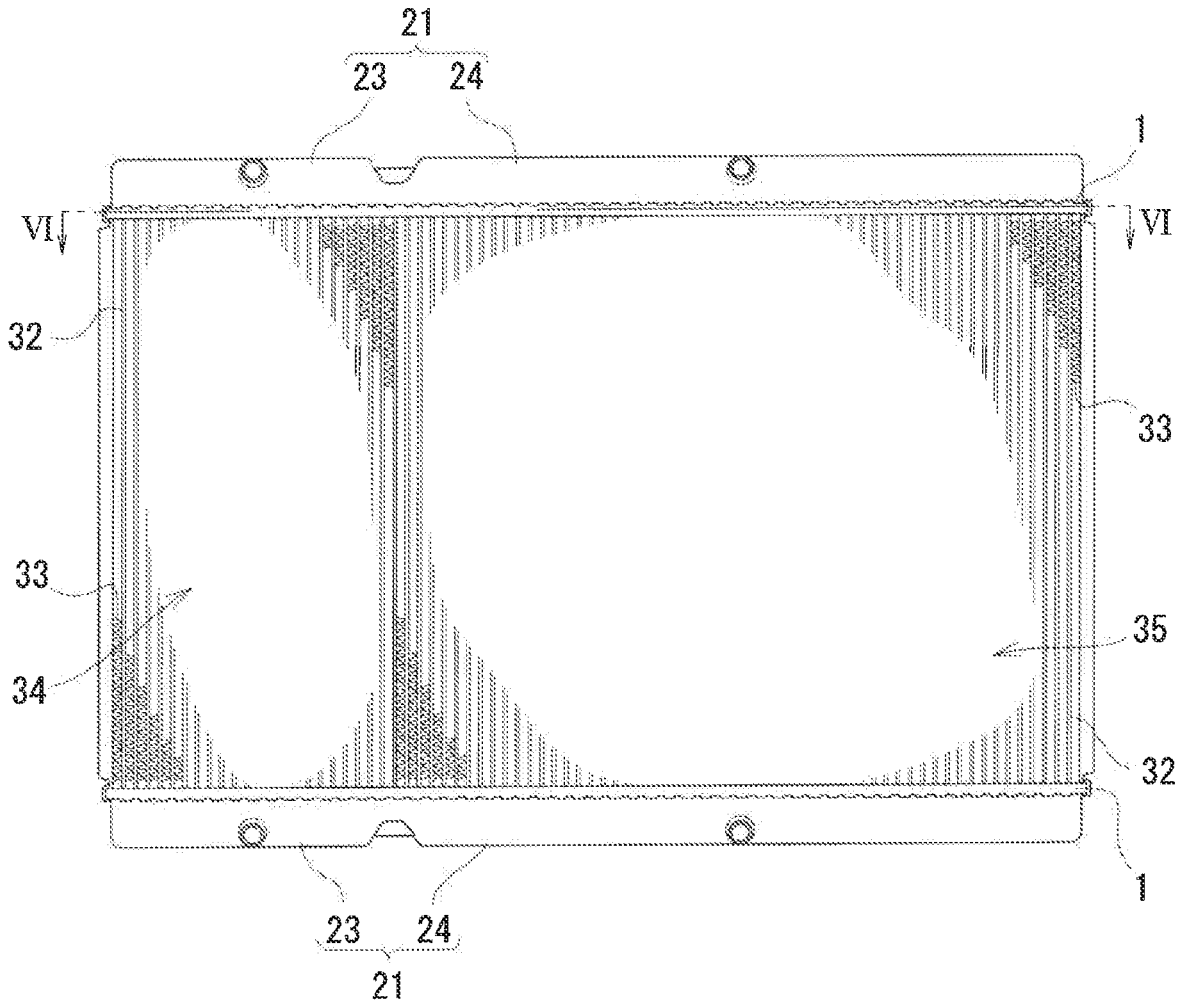
Fig.5 PRIOR ART
FIG. 5 illustrates a front view of a heat exchanger having a tank of a conventional type header plate structure.
Figure 6A:
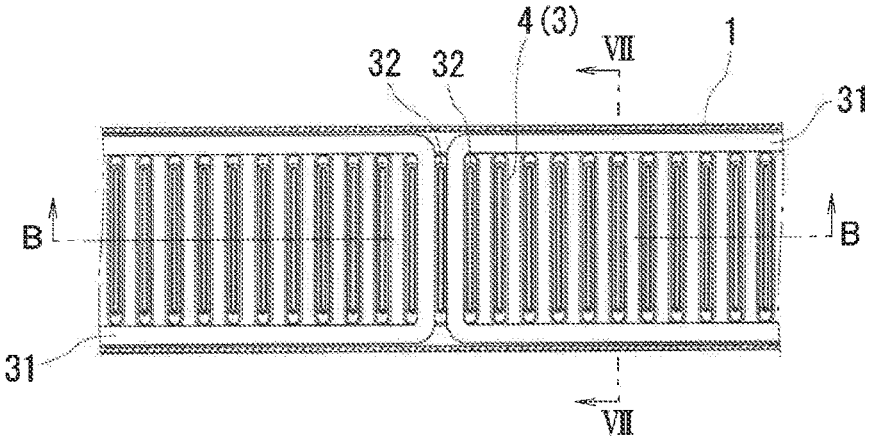
Fig.6A PRIOR ART
FIG. 6A illustrates a main part view seen along a VI-VI arrow in FIG. 5.
Figure 6B:
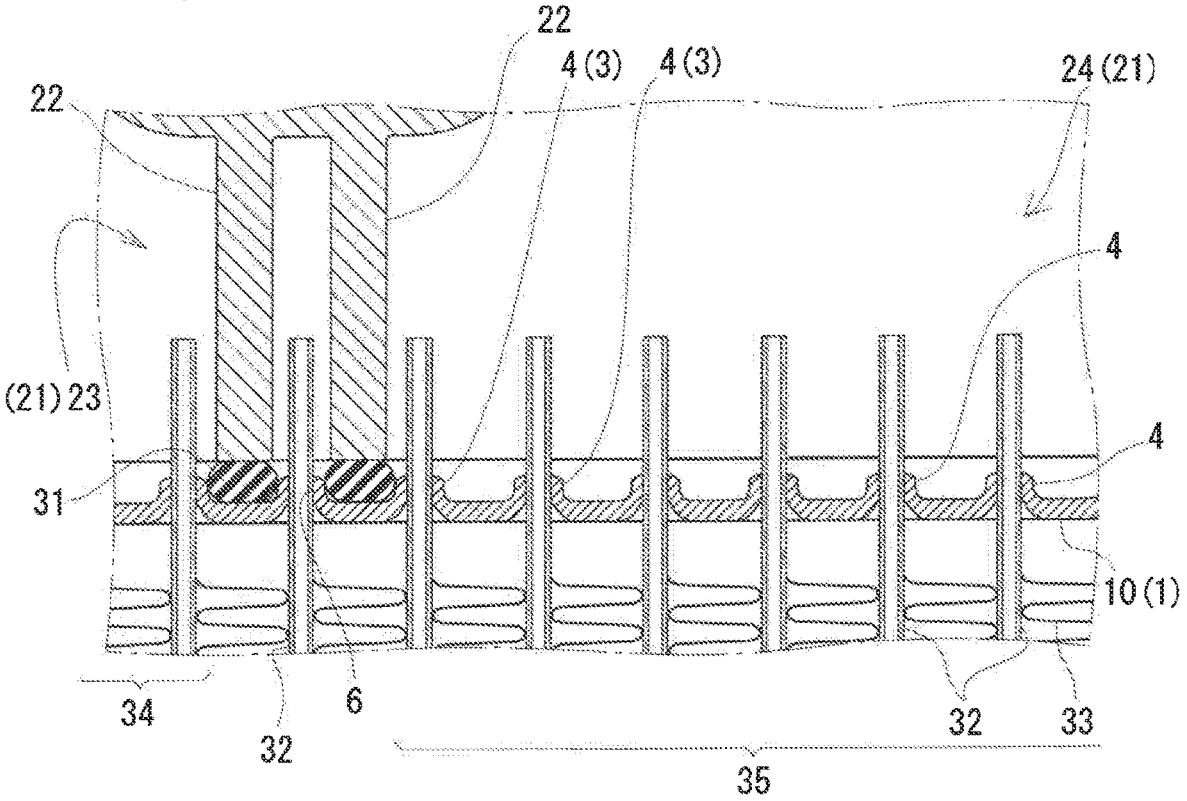
FIG. 6B illustrates a cross-sectional view seen along a B-B arrow in FIG. 6A.
Figure 7:
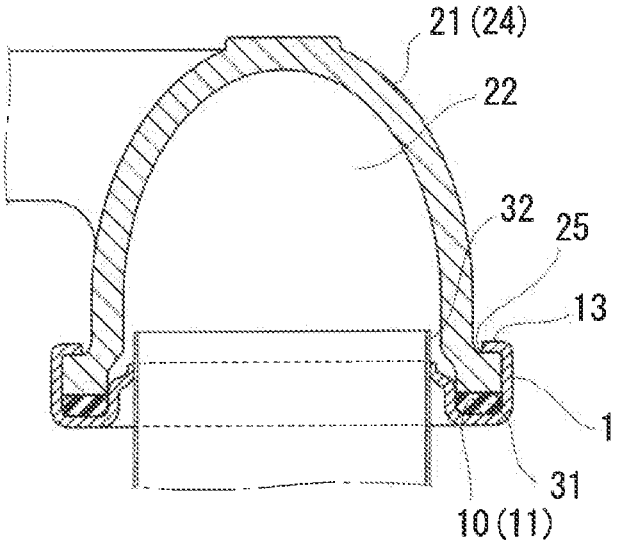
Fig.7 PRIOR ART
FIG. 7 illustrates a cross-sectional view seen along a VII-VII arrow in FIG. 6A.

FIG. 4 illustrates a view showing a problem due to decrease in a sealing surface if the height H1 of the burring 8 of the dummy tube insertion hole 6 is formed with height around half of the height H2 of the burring 8 of the end portion tube insertion hole 5 adjacent to the dummy tube insertion hole 6, in other words around the same as the height H3 (a curvature radius R3 around half of the curvature radius R2 of the burring 8) of the burring 8 of the end portion tube insertion hole 5 deviated from positions adjacent to the dummy tube insertion hole 6 in FIG. 1B.

In this instance, as shown in FIG. 4, the root 8*b* of the burring 8 of the end portion tube insertion hole 5 adjacent to the dummy tube insertion hole 6 will shift to the adjacent dummy tube insertion hole 6 side. Accordingly, in an instance where the height H1 of the dummy tube insertion hole 6 is set to be around the same as the burring height H3, width W2 of the intertube sealing surface 12 becomes narrower, to make securement of sufficient intertube sealing surface 12 difficult. That is, as in FIG. 4, the sealing ring 31 runs on the burring 8 of the dummy tube insertion hole 6, and sufficient sealing effect around the partitioning portion 22 of the tank main body 21 cannot be expected.

Thus, as shown in FIG. 1B, FIG. 2B, by forming the height H1 of the burring 8 of the dummy tube insertion hole 6 lower than the height H2 of the burring 8 of the end portion tube insertion hole 5 adjacent to the dummy tube insertion hole 6 and making the curvature radius R1 of the burring 8 smaller than the curvature radius R2 of the burring 8 of the end portion tube insertion hole 5 adjacent to the dummy tube insertion hole 6, a position of the root 8*b* from which the burring 8 rises is shifted to the dummy tube insertion hole 6 side to thereby give wider width W1 of the intertube sealing surface 12. Consequently, an intertube sealing surface 12, which is sufficient to exhibit effect of the sealing ring 31 around the partitioning portion 22 of the tank main body 21, can be secured.

Preferably, the ratio of the height H1 of the burring 8 of the dummy tube insertion hole 6 and the height H2 of the burring 8 of the end portion tube insertion hole 5 lies in a range of $H2/H1 \geq 1.5$.

An increased height H2 of the burring 8 of the end portion tube insertion hole 5 adjacent to the dummy tube insertion hole 6 can reduce more and more the stress applied to the joined portion between the flat tube 32 and the burring 8 of the end portion tube insertion hole 5 adjacent to the dummy tube insertion hole 6.

Specifically, in an instance where the height H2 of the burring 8 of the end portion tube insertion hole 5 adjacent to the dummy tube insertion hole 6 is set to be 1.5 times or more the height H1 of the burring 8 of the dummy tube insertion hole 6, distance from the root 8*b* of the burring 8 to the joint surface 9 of the flat tube 32 may become further longer to improve the stress reduction effect.

Height of short side portions linking the long side portions of the dummy tube insertion hole 6 and of the end portion tube insertion hole 5 is preferably set to be equal to or lower than the height of the long side portion of the dummy tube insertion hole 6 and of the end portion tube insertion hole 5.

The invention claimed is:

1. A header plate structure of a heat exchanger, comprising:

an elongated header plate, in which a plurality of tube insertion holes constituted of a pair of short side portions facing each other and a pair of long side portions linking between both of the short side portions are formed in a bottom surface;

a tank main body caulked and fixed to the header plate via a sealing ring; and a tube having a cross-section constituted of a pair of short side portions facing each other and a pair of long side portions linking between both of the short side portions and whose end portion is inserted into the header plate, the inserted portion being brazed and fixed to form a core, in which:

each short side portion of the plurality of tube insertion holes lies in a width direction of the header plate, and the tube insertion holes are arranged separately from each other in a longitudinal direction of the header plate;

in the tank main body, a pair of partitioning portions that divide a flow path of a heat transfer medium into the core in a longitudinal direction are included, a tube insertion hole arranged between the partitioning portions among the tube insertion holes is formed as a dummy tube insertion hole, and the core is divided at a position of the dummy tube insertion hole, wherein:

each tube insertion hole arranged adjacent to both sides of the dummy tube insertion hole has been formed as an end portion tube insertion hole;

the flat tube has been inserted into each of the tube insertion holes, a burring is formed to a hole edge of each of the tube insertion holes, and the flat tube has been joined on an inner surface near a top portion of the burring of each of the tube insertion holes;

the burring with height H1 is formed to the long side portion of the dummy tube insertion hole;

the burring with height H2 is formed to the long side portion of the end portion tube insertion hole adjacent to the dummy tube insertion hole; and the height H2 of the burring of the end portion tube insertion hole is formed higher than the height H1 of the burring of the dummy tube insertion hole.

2. The header plate structure of a heat exchanger according to claim 1, wherein a ratio of the height H1 of the burring of the dummy tube insertion hole and the height H2 of the burring of the end portion tube insertion hole is $$H2/H1 \geq 1.5.$$

* * * * *